US005528867A

United States Patent [19]

Thompson

[11] Patent Number: 5,528,867

[45] Date of Patent: Jun. 25, 1996

[54] COVER MEMBER FOR A PROTRUDING ROD OF AN ARCHITECTURAL STRUCTURAL MEMBER

[76] Inventor: Harry A. Thompson, 2009 Redwood Ave., Wyomissing, Pa. 19610

[21] Appl. No.: 250,524

[22] Filed: May 27, 1994

[51] Int. Cl.[6] ..... E04G 21/24

[52] U.S. Cl. ..... 52/125.5; 52/125.2; 52/125.4; 52/701; 52/DIG. 12

[58] Field of Search ..... 52/125.5, 125.4, 52/125.3, 125.2, DIG. 12, 701; 220/730, DIG. 21

[56] References Cited

U.S. PATENT DOCUMENTS

| | | | |
|---|---|---|---|
| 811,742 | 2/1906 | Petrie | 220/DIG. 21 X |
| 1,887,002 | 11/1932 | Ziedrich | 52/682 |
| 3,420,014 | 1/1969 | Courtois et al. | 52/125.4 |
| 4,000,591 | 1/1977 | Courtois | 52/125.4 X |
| 4,137,680 | 2/1979 | Doonan | 52/127 |
| 4,301,629 | 11/1981 | Farr | 52/125.2 X |
| 4,807,843 | 2/1989 | Courtois et al. | 52/125.4 X |

FOREIGN PATENT DOCUMENTS

| | | | |
|---|---|---|---|
| 901681 | 7/1962 | United Kingdom | 52/701 |

*Primary Examiner*—Carl D. Friedman
*Assistant Examiner*—Laura A. Saladino
*Attorney, Agent, or Firm*—Sanford J. Piltch

[57] ABSTRACT

A cover member that engages a hook member formed into a precast, reinforced concrete block. The hook member assists in the lifting, transporting and manipulating of the precast, reinforced concrete block. The cover member is formed of a water resistant, flexible and resilient material. Preferably, the cover member has a shape similar to a hat with the apex of the crown thereof being opened by way of an inwardly tapered aperture having at least one slit therein. The tapered aperture has an entrance portion dimensioned to accommodate the insertion of the head of the hook and an exit portion dimensioned to engage the shank of the hook. A slit of the aperture is dimensioned to allow the exit portion of the aperture to rigidly engage the shank of the hook as the precast, reinforced concrete block encounters movement.

14 Claims, 3 Drawing Sheets

COVER MEMBER FOR A PROTRUDING ROD OF AN ARCHITECTURAL STRUCTURAL MEMBER

FIELD OF THE INVENTION

The present invention relates to a cover that is placed over a rod used in the handling of an architectural structural member. More particularly, the present invention relates to a cover that is placed over a rod or hook that extends out of a precast, reinforced concrete block and which may be seized by a hoisting apparatus during the movement and manipulation of the precast reinforced concrete block. Specifically, the present invention relates to a polyethylene cover that engages and stays with the extending hook during the transportation, manipulation and even after the precast, reinforced concrete block has been manipulated and installed in place as an architectural structural member.

BACKGROUND OF THE INVENTION

Concrete, in its hardened state, is a hard, strong building material used in the formation of domestic, commercial and industrial facilities. Concrete is strong in compression, but relatively weak in tension. The reverse is true for slender steel rods. But when the two materials are used together, one makes up for the deficiency of the other. When steel is embedded into concrete in a manner that assists it in carrying an imposed load, the combination of a welded wire mesh or an expanded metal mesh, but more commonly consisting of steel bars, with the concrete creates a very strong building material.

Reinforced concrete has become the most common material in foundations for buildings because it has the advantage of acting as a monolithic member; it resists moisture penetration better than foundations made of many units with many joints. Further, reinforced concrete, because of its ability to support weight, not only finds frequent application in foundation structures, but also various other domestic, highway, commercial and industrial applications. Furthermore, reinforced concrete finds applications in lintels, which are horizontal architectural members spanning and usually supporting a load above a relatively wide opening, such as those found above windows and doors.

Reinforced concrete blocks are commonly precast; that is, reinforced concrete blocks are fabricated at a place other than its final point of use. It can be done anywhere, although this procedure is best adapted to a factory or to an outside commercial facility. The precast, reinforced concrete blocks vary in size, in width, and in depth, but usually are of a relatively large size having a typical weight given in tons; for example, eight (8) tons.

The relatively heavy precast, reinforced concrete blocks are commonly provided with rods, sometimes referred to as hooks, that extend or protrude out of the block and are used to assist in their transportation, movement and manipulation. The hooks are commonly inserted into the associated precast, reinforced concrete block prior to its hardening, remain therein and become an integral part thereof, and are capable of supporting the weight of the associated block so as to accommodate its movement. For example, a hoisting apparatus, such as a crane, may have means for attaching to these extending hooks so that the precast, reinforced concrete block is hoisted and manipulated into its final in-place position as an architectural structural member for a highway or for a domestic, commercial or industrial facility.

The extending hooks usually have a blunt outer end and are commonly provided with cap or cover members having a tubular member with an inner diameter thereof chosen so as to provide frictional engagement when the cover member is inserted over the outer diameter of the extending hook. The cover member serves the function of confining the blunt hook, which may otherwise be hazardous during transportation, and also provides a barrier that is used to mate and blend the blunt hook into its contacting architectural member, such as a concrete wall. The barrier prevents the extending hook from physically contacting the architectural member so that the hook does not cause any discoloring thereof or other undesired chemical reaction therebetween usually created by water or moisture reacting with the material comprising the hook. The cover member is selected of material that allows it to mate with unhardened cement and later become bonded thereto. Although the tubular cover member serves its intended purposes, it does suffer drawbacks in that the frictional contact is insufficient to allow the cover member to remain with the hook of the precast, reinforced concrete blocks during the transportation, hoisting, or manipulation of the block into place within a structural facility, such as a building. Further, the cover member, having a tubular member, is lacking in any provision that allows for the associated precast, reinforced concrete member to experience the full range of its operational movement, such as possibly occurring during expansion or contraction conditions of the facility in which the precast, reinforced concrete block is placed. It is desired that a cover member be provided that does not suffer the drawbacks of the prior art tubular cover member.

It is, therefore, a primary object of the present invention to provide a cover member that mechanically engages and stays with the hook of a precast, relatively heavy precast, reinforced concrete block as the block is being transported, manipulated and mated to its associated architectural structural member.

It is a further object of the present invention to provide a cover member that allows the precast, reinforced concrete block, in particular, the hook rod extending from the concrete block to be merged with a concrete wall and provide a water barrier therebetween.

It is a still further object of the present invention to provide a cover member that allows for a relatively heavy, precast, reinforced concrete block to be mated with a stationary member but still allows for relative movement therebetween as the precast, reinforced concrete block experiences operational movement.

Further objects and features of the present invention will become evident hereinafter.

SUMMARY OF THE INVENTION

The present invention is directed to a cover member that mechanically engages and stays with a hook that extends out of a precast, reinforced concrete block as the block is being transported and/or manipulated into its final position serving as an architectural structural member.

In one embodiment, the cover member mechanically engages a hook member having a head with a first predetermined diameter, a shank with a second pre-determined diameter which is less that the first pre-determined diameter, and preferably a sloped section that structurally merges the head to the shank. The cover member is comprised of a platter and a vessel. The platter has a rim and first and second opposite sides, with the first side serving as the face of the cover member. The vessel has a continuous side wall with first and second opposite portions, with the first opposite portion being merged to the second side of the platter and the second opposite portion having an inwardly tapered aperture having at least one slit in the second opposite portion. The inwardly tapered aperture has an entrance portion dimensioned to accommodate the insertion of the head of the hook and an exit portion with a continuous vertical wall dimensioned to engage the shank of the hook.

BRIEF DESCRIPTION OF THE DRAWINGS

For the purpose of illustrating the invention, there is shown in the drawings, embodiments which are presently preferred; however, it should be understood, that this invention is not limited to the precise arrangements and instrumentalities shown.

DETAILED DESCRIPTION OF THE PREFERRED EMBODIMENTS

The following detailed descriptions are for the best presently contemplated modes of carrying out the present invention. These descriptions are not intended in any limiting sense, but rather are made solely for the purposes of illustrating the general principles of the present invention.

Figure 1:
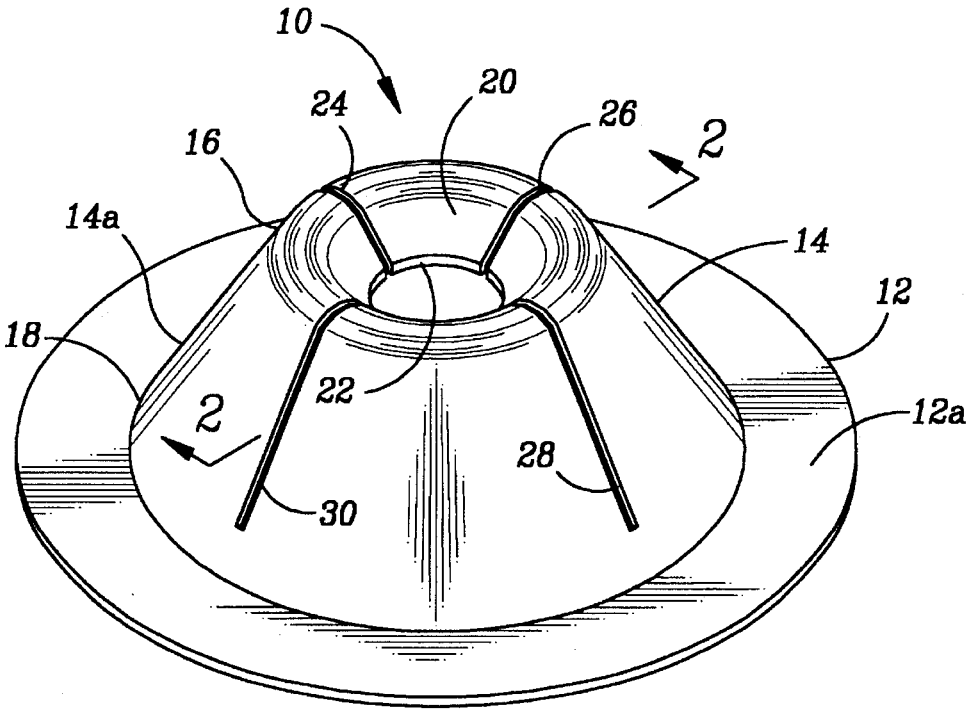
FIG. 1 is a perspective view of a cover member embodying the principles of the present invention.

Referring now to the drawings in detail, wherein like numerals indicate like elements, there is shown in FIG. 1, a cover member 10 embodying the principles of the present invention. The cover member 10 comprises a high density polyethylene material having a color concentrate, an ultraviolet inhibitor and has a surface that allows it to mate with and be bonded by a concrete material. As is known, the polyethylene material acts as a barrier to prevent water from reacting with the device which member 10 covers and, similarly, the ultraviolet inhibitor retards any degradation caused to the cover member 10 by ultraviolet rays. Further, the polyethylene material is somewhat flexible and resilient so that the cover member 10 (as to be further described) may be first bowed outward and then automatically returned to its original shape.

The cover member 10 comprises a platter 12 with a rim portion 12*a* and a vessel 14 with a continuous side wall 14*a* having first and second opposite portions 16 and 18, respectively, shown in FIG. 1 in one orientation at the upper and lower regions thereof. The apex of upper region 16 mates with an inwardly tapered aperture 20, whereas the lowermost portion of the lower region 18 mates with the rim 12*a* of platter 12 and provides an internal hollow or pocket (to be described with reference to FIG. 2) region of the cover member 10. The cover member 10 preferably has the shape of a hat with the platter 12 serving as the brim and with the vessel 14 serving as the crown.

The inwardly tapered aperture 20 preferably has continuous, vertical wall 22 with a sharp lip at its innermost portion. Also, at least one, but preferably four, slits 24, 26, 28 and 30 with at least one slit, but preferably two slits 28 and 30, longitudinally extend through a major portion of the side or vertical wall 14*a* (as illustrated in FIG. 1) of vessel 14. Further details of the inwardly tapered aperture 20 may be further described with reference to FIG. 2, which is a view taken along line 2—2 of FIG. 1.

Figure 2:
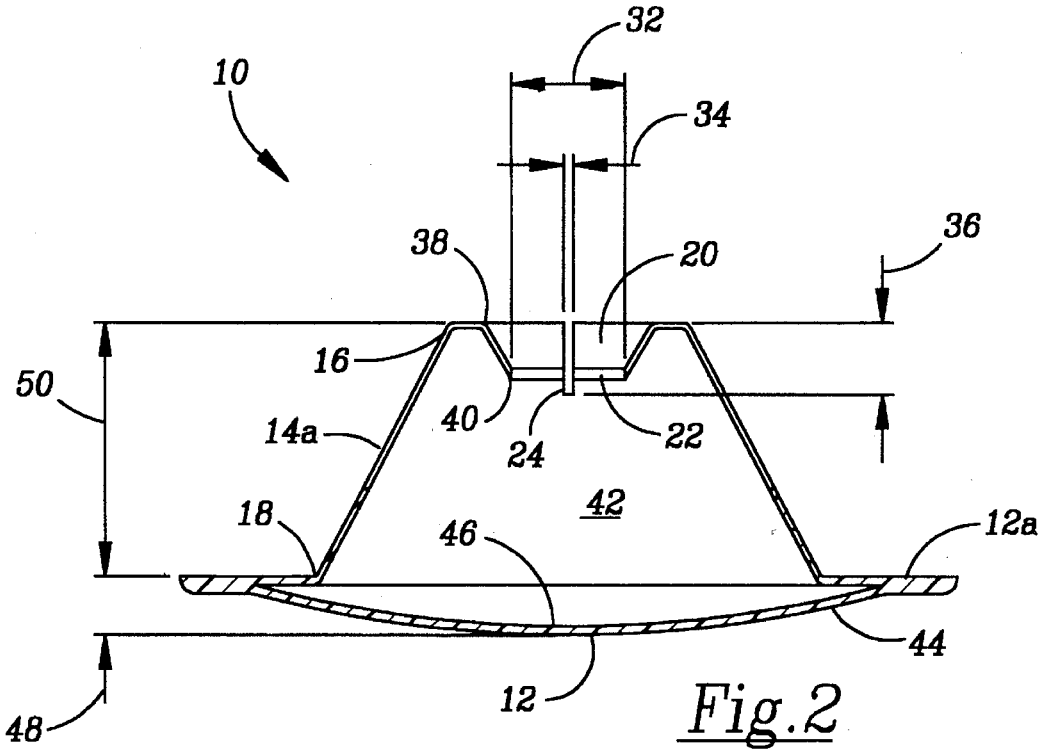
FIG. 2 is a view, taken along the line 2—2 of FIG. 1, illustrating details of the pocket region within of the cover member of FIG. 1.

FIG. 2 illustrates the vertical wall 22 with a sharp inward facing lip of the aperture 20 having a diameter 32 with a typical value of about 1.0 inches. The slit 24, which extends through the vessel side wall 14*a* and the inwardly sloping wall of the aperture 20 is illustrated as having a width 34 with a typical value of about 0.05 inches and a depth 36 having a typical value of about 0.5 inches. The inwardly tapered aperture 20 has an entrance portion 38 and an exit portion 40 that leads into a hollow 42 formed by the platter 12 and the vessel 14, as previously discussed with reference to FIG. 1. The exit portion 40 may also be described as the sharp inwardly facing lip of the vertical wall 22.

As seen in FIG. 2, the platter 12 has first and second surfaces or sides 44 and 46, respectively, with the first surface 44 serving as the face of the cover member 10. The face 44 preferably bows outward, in a convex manner, and extends outward from the rim 12*a* at its most outward portion by a distance 48 having a typical value of about 0.5 inches. As further seen in FIG. 2, the vessel 14, in particular its side wall 14*a*, has a height 50 having a typical value of about 2.0 inches. As will be more fully described, all of the dimensions shown in FIG. 2 are pre-determined quantities so that the exit portion 40, in particular the lip of vertical wall 22, mechanically engages the device that the member 10 covers. The pre-determined dimensions of the cover member 10 may be further described with reference to FIG. 3.

Figure 3:
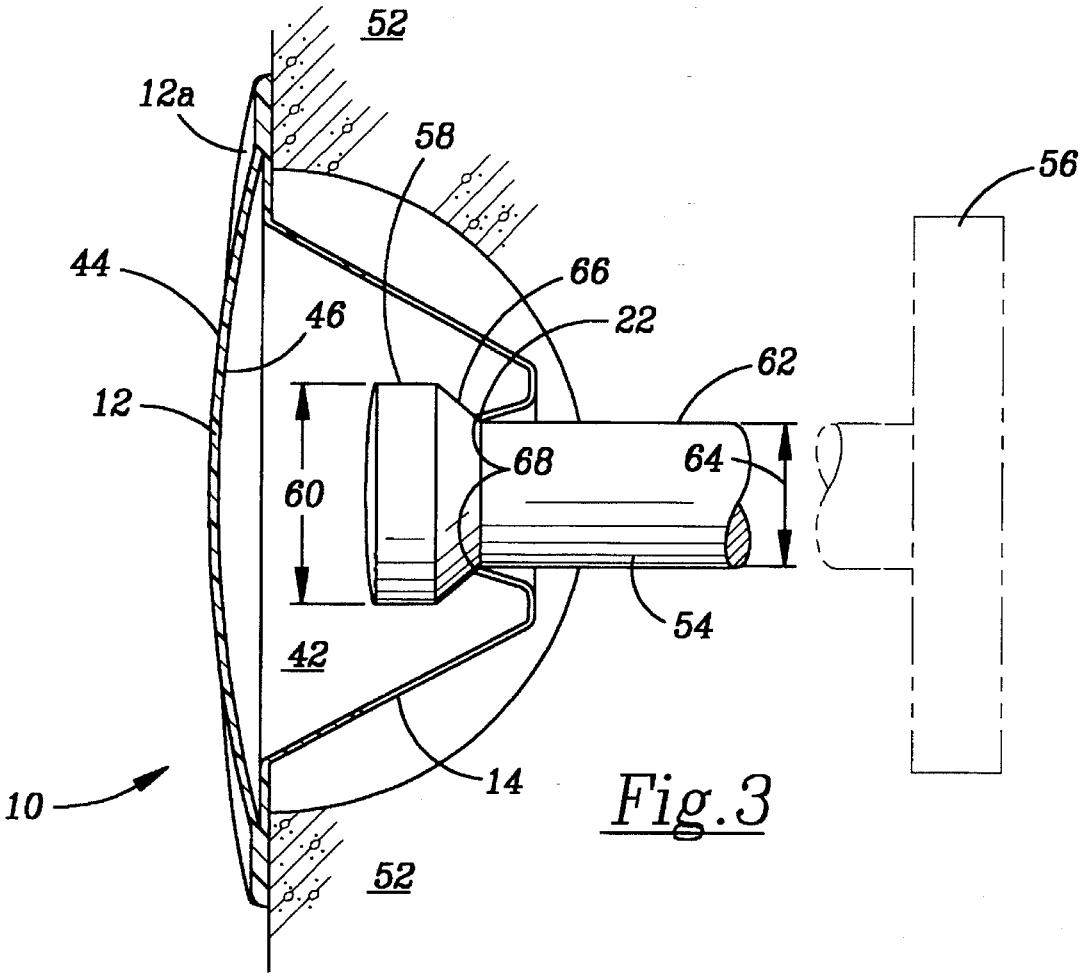
FIG. 3 is a partially cut away view that illustrating the mechanical engagement of the cover member to a hook member that extends out of a precast, reinforced concrete block to move relative to a stationary concrete structure.

FIG. 3 illustrates the cover member 10 as mating with a stationary concrete wall 52 and mechanically engaging a rod or hook 54 that extends out of a precast, reinforced concrete block 56, with both the hook 54 and block 56 being such as those previously described in the "Background" section. The hook 54 extends far enough outward from the precast, reinforced concrete block 56 so that the hook 54 may be grasped by appropriate means of a hoisting apparatus (not shown). The hoisting apparatus, such as a crane, is commonly used for the movement and/or manipulation of the precast, reinforced concrete block 56 into its final position as a structural support member of a highway or within a domestic, commercial or industrial facility. The hook member 54 is capable of supporting the precast, reinforced concrete block 56 which has a typical weight of eight (8) tons.

In one embodiment, the hook 54 has a head 58 with a first pre-determined diameter 60, a shaft or shank 62 with a second pre-determined diameter 64 (which is less than the first pre-determined diameter 60), and preferably a sloped section 66 that structurally merges the head 58 to the shank 62. The pre-determined dimensions of the inwardly tapered aperture 20, in particular, the entrance portion 38, the exit portion (or lip) 40, and the vertical wall 22 (see FIG. 2) are all selected so that the vertical wall 22 mechanically engages the shank 62 at location 68 shown in FIG. 3. The mechanical engagement at location 68 may be further described with reference to FIG. 4.

Figure 4:
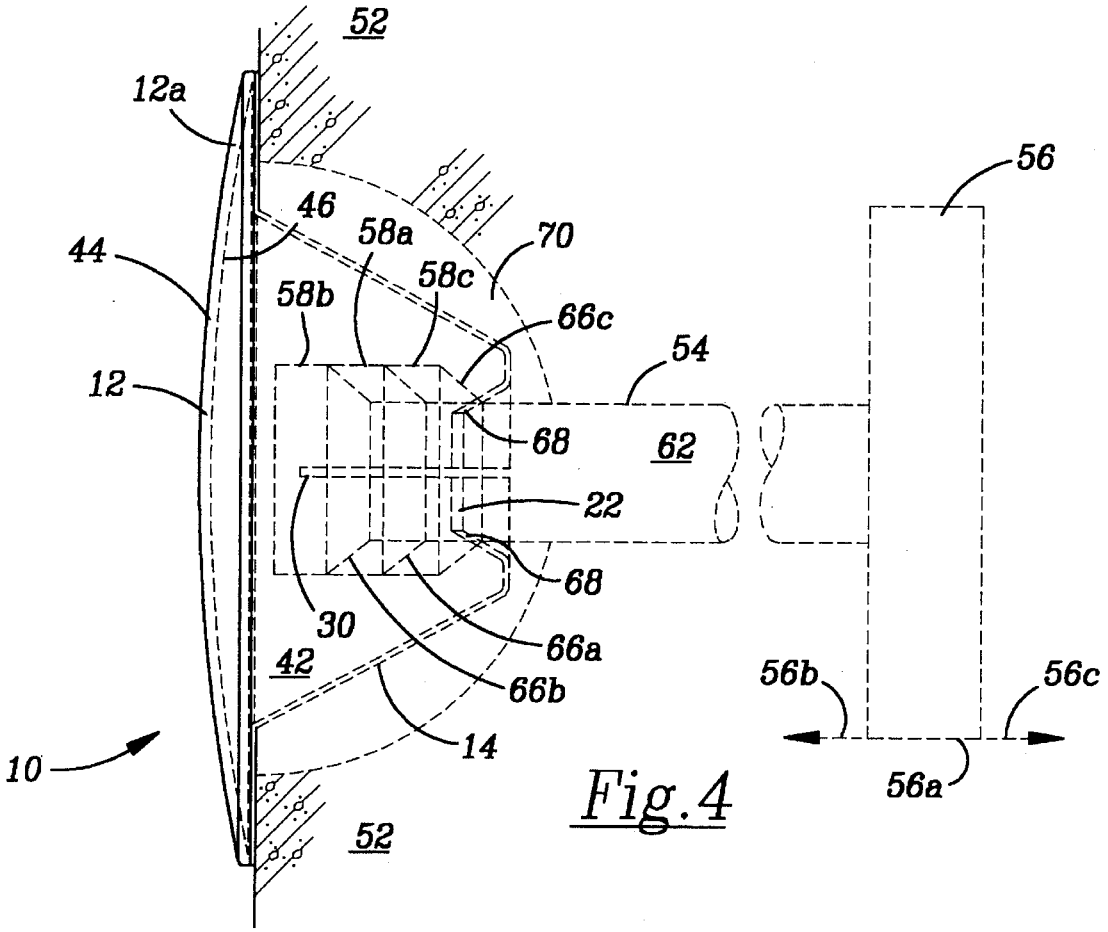
FIG. 4 is an enlarged, partially cut away view of FIG. 3 illustrating the relative motion of the hook member within the cover member of the present invention.

FIG. 4 is similar to FIG. 3, but is somewhat enlarged therefrom and does not fully show the internal pocket 42.

FIG. 4 illustrates the cover member 10, in particular the rim 12*a* of platter 12, as being mounted flush against the concrete wall 52, and the vessel 14 of cover member 10 as being merged into a recess 70 in the concrete wall 52 so that cover member 10 remains fixed to the concrete wall 52. It should be noted, however, that the concrete wall 52 of FIGS. 3 and 4 does not completely contact the vessel 14 so that, as will be further described, the vessel 14, in particular the regions proximate to the slits, 24, 26, 28 and 30, may experience some flexing to accommodate the movement of the hook 54. FIG. 4 further illustrates the location 68 of the mechanical engagement of hook 54 as being relatively fixed, whereas the head 58 of hook 54 is shown to have three positions or segments 58*a*, 58*b*, and 58*c* and, similarly, the precast, reinforced concrete block 56 is also shown to have three positions or segments 56*a*, 56*b*, and 56*c* that respectively correspond to positions 58*a*, 58*b* and 58*c*. Further, as seen in FIG. 4, all of the positions 58*a*, 58*b*, and 58*c* are confined within the inner pocket 42 of the cover member 10. Still further, FIG. 4 illustrates the slit 30, which longitudinally extends through a major portion of the side wall of vessel 14, in its horizontal position, but which may be oriented in any other position dependent upon how the precast, reinforced concrete block 56 is arranged within its associated building facility.

In operation, the cover member 10 is affixed to the concrete wall 52 and remains in a stationary position, whereas the precast, reinforced concrete block 56, usually in a stationary condition denoted by position 56*a*, may sometimes encounter movement, usually in a lateral manner, so that it may reposition itself inward in the direction of position 56*b* or outward in the direction of position 56*c* (as shown in phantom line in FIG. 4). Because the hook 54 is embedded in the precast, reinforced concrete block 56, the head 58 correspondingly follows the movement of the precast, reinforced concrete block 56. When the precast, reinforced concrete block 56 is at its stationary position, the head 58 of the rod 54 is at position 58*a*. Similarly, when the precast, reinforced concrete block 56 moves inward, denoted by 56*b*, the head 58 of hook 54 moves to position denoted by 58*b*. Similarly, as the precast, reinforced concrete block 56*c* moves outward, as denoted by 56*c*, the head 58 of hook 54 moves outward as denoted by 58*c*. The sloped portion 66 of the shank 62 is shown in corresponding locations to the several positions of the head 58 as indicated at 66*a*, 66*b* and 66*c*.

The cover member 10 has provisions that allow for the movement of the precast, reinforced concrete block 56 even though the cover member remains in a fixed orientation. During all of the movements of the precast, reinforced concrete block 56, the inward tapered aperture 20, in particular, the sharp inwardly facing lip 40 of the vertical wall 22 mechanically engages the shank 62 (see FIG. 3) at location 68 so as to ride thereon. As the hook 54 moves outward in the direction of 56*c*, the vessel 14, in particular the slit 30, as well as the other slits 24, 26, 28 allow the vessel 14 to bow outward, while still allowing the lip 40 of the vertical wall 22 to retain its mechanical engagement of the shank 62 of hook 54, although the lip 40 of the vertical wall 22 may slightly ride upward from the shank 62 to the sloped portion 66 (see FIG. 3) of the hook 54. The sloped portion 66 acts as an abutment which engages the lip 40 of the vertical wall 22 and correspondingly causes the spreading of the slits 24, 26, 28 and 30. The spreading of slits 24, 26, 28 and 30, in cooperation with the inherent tendency of resilient material comprising the cover member 10 to flex, allows the movement of hook 54 to be captured by the vertical wall 22, while the inwardly tapered aperture 20 correspondingly spreads or expands outward. As the hook 54 moves in the direction of 58*b*, the lip 40 of the vertical wall 22 maintains the mechanical engagement with shank 62 by frictional means (not the spreading of the slits 24–30) due to the preselected dimensions for the diameter 32 of the aperture 20 surrounded by the vertical wall 22.

It should now be appreciated that the practice of the present invention provides for a cover member 10 that allows for the relatively heavy, precast, reinforced concrete block 56 to experience movement within the hollow 42, while the cover member 10 adheres to the concrete wall 52.

The description relating to FIG. 4 of the cover member 10 mechanically engaging the hook 54 during its movement, is equally applicable to the mechanical engagement of the cover member 10 to the hook 54 as the precast, reinforced concrete block 56 is moved from one location to another before it is finally maneuvered into its in-place position as an architectural structural member.

Although the hereinbefore description was addressed to the vertical wall 22 mechanically engaging a shank 62 and frictionally coming into contact with sloped section 66 acting as an abutment as the hook 54 attempts to move out of the cover member 10, the practice of the present invention contemplates configurations of abutments other than sloped section 66. For example, the abutment need only comprise a raised portion on the shank 62 that is wide lip 40 of the vertical wall 22 does not ride over the raised portion as the hook 54 attempts to move out of the confines of the cover member 10.

Furthermore, the practice of this invention contemplates the elimination of a separate abutment means by having the head 58, having a greater diameter that the shank 62, coming into contact with the vertical wall 22 and, thereby, initiating the outward spreading of the resilient vessel 14 so that the cover member 10 retains the captured hook 54 with the hollow 42 during any movement thereof.

It should now be appreciated that the practice of the present invention provides for a cover member 10 that allows the precast, reinforced concrete block 56, having the hook 54 extending therefrom, to be moved from a remote location and mated with its complementary architectural structural element while the cover member 10 maintains its mechanical engagement with hook 54.

Although the hereinbefore given description has been primarily related to concrete construction members, the principles of the cover member are equally applicable to other type structural members or even to other types of heavy objects. For example, the practice of the present invention may very well find application by providing a cover that encompasses a protruding rod of a structural member, such as a railroad tie or a telephone pole, that comprise wood or some other material.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. A cover member that is adapted to mechanically engage a hook member that is formed into a recess in an object, said hook member extending outward into said recess and having a head with a first pre-determined diameter, a shank with a second pre-determined diameter which is dimensionally less than said first pre-determined diameter, and a sloped section which structurally merges said head to said shank, said cover comprising a resilient material and including;

a platter having first and second sides with the first side serving as the face of said cover member; and a vessel with a continuous side wall having first and second opposite portions with the second opposite portion merged to the second side of said platter forming a hollow pocket therebetween and the first opposite portion having an inwardly tapered aperture and having at least one slit therein, said inwardly tapered aperture having an entrance portion dimensioned to accommodate the insertion of said head of said hook member and an exit portion with a vertical wall having a lip at the distal end of said wall dimensioned to engage said shank of said hook member, whereby said cover member has the shape of a hat with said vessel forming a crown of said hat for encompassing the head of said hook member within the hollow pocket of said vessel and said platter forming a brim of said hat for overlying said object adjacent said recess.

2. The cover member of claim 1, wherein said inwardly tapered aperture has four spaced-apart longitudinal slits with at least one of said slits extending through a major portion of said continuous wall of said vessel.

3. The cover member of claim 1, wherein said inwardly tapered aperture is dimensioned to accommodate a hook member having a round head and a round shank.

4. The cover member of claim 3, wherein said at least one slit is dimensioned to allow the lip of the vertical wall of the exit portion to rigidly engage said shank and said sloped section as the hook member encounters movement when the cover member is retained in place.

5. The cover member of claim 1, wherein said first side of said platter has a convex shape.

6. The cover member of claim 1, wherein said platter and said vessel comprise a polyethylene material.

7. The cover member of claim 1, wherein said platter and said vessel comprise an ultraviolet inhibitor and both have a surface adapted so as to be able to adhere to an unhardened concrete material to enable said cover member to bond with hardened concrete material.

8. A cover member that is adapted to mechanically engage a hook member formed in a recess in a precast, reinforced concrete block, said hook member extending outward into said recess and having a head with a first pre-determined diameter, a shank with a second pre-determined diameter which is less than the first pre-determined diameter, and a sloped section serving as abutment means and that structurally merges the head with the shank, said cover member comprising a resilient material and including:

a platter member having first and second sides with the first side serving as the face of said cover member;

a vessel with a continuous side wall and having first and second opposite portions with the second opposite portion merged to the second side of said platter forming a hollow pocket therebetween and the first opposite portion having an inwardly tapered aperture having at least one slit therein, said inwardly tapered aperture having an entrance portion dimensioned to accommodate, in cooperation with said at least one said slit, the insertion of said head of said hook member, and an exit portion dimensioned to engage, in cooperation with said at least one slit, said shank of said hook member, whereby said cover member has the shape of a hat with said vessel forming a crown of said hat for encompassing the head of said hook member within the hollow pocket of said vessel and said platter forming a brim of said hat for overlying said object adjacent said recess.

9. The cover member of claim 8, wherein said inwardly tapered aperture has four spaced-apart longitudinal slits with at least one of said slits extending through a major portion of said continuous wall of said vessel.

10. The cover member of claim 8, wherein said inwardly tapered aperture is dimensioned to accommodate a hook member having a round head and a round shank.

11. The cover member of claim 10, wherein at least one slit is dimensioned to allow the exit portion to rigidly engage said shank and said sloped section as the hook member encounters movement when the cover member is retained in place.

12. The cover member of claim 8, wherein said first side of said platter has a convex shape.

13. The cover member of claim 8, wherein said platter and said vessel comprise a polyethylene material.

14. The cover member of claim 8, wherein said platter and said vessel comprise an ultraviolet inhibitor and both have a surface adapted so as to be able to adhere to an unhardened concrete material to enable said cover member bond with hardened concrete material.

* * * * *